US006864908B2

(12) United States Patent
Corona et al.

(10) Patent No.: US 6,864,908 B2
(45) Date of Patent: Mar. 8, 2005

(54) PRINTHEAD WITH PLURAL ARRAYS OF PRINTING ELEMENTS

(75) Inventors: Stephen C. Corona, Rochester, NY (US); Donald J. Drake, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/349,365

(22) Filed: Jan. 22, 2003

(65) Prior Publication Data

US 2004/0141050 A1 Jul. 22, 2004

(51) Int. Cl.[7] ..... B41J 2/45
(52) U.S. Cl. ..... 347/238
(58) Field of Search ..... 347/130, 238, 347/240, 251, 253, 254, 237, 244, 247, 258, 37, 131, 137; 355/20

(56) References Cited

U.S. PATENT DOCUMENTS 4,571,602 A 2/1986 De Schamphelaere et al. .. 347/238
4,797,691 A 1/1989 Akiyoshi et al. ..... 347/232
5,016,040 A * 5/1991 Dwyer, III ..... 355/20
5,317,344 A * 5/1994 Beaman et al. ..... 347/237
5,382,966 A 1/1995 Doi ..... 347/238
5,874,984 A * 2/1999 Scholz et al. ..... 347/238
5,896,162 A * 4/1999 Taniguchi ..... 347/244
5,946,010 A * 8/1999 Isobe et al. ..... 347/37
6,252,622 B1 * 6/2001 Laberge ..... 347/238
6,559,879 B1 * 5/2003 Kobayashi et al. ..... 347/238

FOREIGN PATENT DOCUMENTS

JP 2000114203 A * 4/2000 ..... H01L/21/301
JP 2000289250 A * 10/2000 ..... B41J/2/44
WO WO 82/04353 12/1982

OTHER PUBLICATIONS

JP 61 160982, "Led Array Head", Abstract, publication Date Jul. 21, 1986.

* cited by examiner

*Primary Examiner*—Hai Pham
(74) *Attorney, Agent, or Firm*—Perman & Green, LLP

(57) ABSTRACT

A xerographic print engine employs a photoreceptor with an image receiving surface, a printhead for directing light to the photoreceptor to produce thereon a latent image, and a developer for converting the latent image to a printable image to be transferred from the photoreceptor to a print medium during a relative motion between the photoreceptor and the print medium. The printhead has light emitting diodes disposed in plural rows arranged alongside each other on a substrate which also supports driver circuitry connecting with imaging electronics for activating individual ones of the diodes. An optical element focuses light of the diodes onto a row of the latent image, the focussing being accomplished concurrently for individual ones of the diodes located in a plurality of the rows.

20 Claims, 7 Drawing Sheets

PRINTHEAD WITH PLURAL ARRAYS OF PRINTING ELEMENTS

BACKGROUND OF THE INVENTION

This invention relates to a printhead for a printing engine, such as a xerographic printing engine, having printing elements arranged in a plurality of arrays and, more particularly, to a printhead with separately energizable parallel arrays of light emitting elements positioned for illumination of a common region of image space.

Xerographic print engines are constructed, typically, with a drum of photosensitive material providing a photoreceptor surface for receipt of a latent image, the drum being operated in conjunction with a developer that converts the latent image to a printable image by use of electrostatic charges for securing toner particles to the photoreceptor surface at the latent image. The latent image is produced by a printhead having sources of light, such as a single line of light-emitting diodes (LEDs) serving as points of an object to be imaged, and an elongated optical focussing element which focuses the line of LEDs upon the photoreceptor surface to produce the latent image.

Due to the construction of printheads with a single line of LEDs, a faulty diode introduces a noticeable pattern in the printed image outputted by the print engine, which pattern manifests itself as a streak or line which is disturbing to a person viewing the printed image. Furthermore, it is recognized that inputted data to the engine, from which data the latent image is created, may be for a relatively low or a relatively high resolution image, yet the engine is capable of printing only at the higher value of resolution.

SUMMARY OF THE INVENTION

The aforementioned disadvantages are overcome and other benefits are provided by a printhead constructed of plural rows of light-emitting print elements in accordance with a first aspect of the invention, and a xerographic print engine operative with the printhead in accordance with a further aspect of the invention, wherein, in the printhead, the plural rows are located side by side within an object plane of a focussing element capable of concurrently focussing the light from the plural rows of printing elements to generate a row of image points in a latent image on a photoreceptor of the engine.

The print engine comprises a photoreceptor with an image receiving surface, and a developer for converting a latent image produced on the receiving surface to a printable image to be transferred from the photoreceptor to a print medium. The printhead directs light to the photoreceptor to produce the aforementioned latent image, and a printing controller imparts relative motion between the photoreceptor and the print medium to print the printable image on the medium. The print controller includes imaging electronics for applying imaging data to the printhead for generation of the latent image.

The printhead generates a set of points of the latent image, the latent image being composed of rows of the image points. The printhead is constructed with a substrate extending in a direction parallel to a row of the latent image, and includes an arrangement of light-emitting printing elements disposed in plural arrays on the substrate. The plural arrays of the printing elements extend in a direction parallel to the row of the latent image. A first of the plural arrays is located alongside a second of the plural arrays. Also included in the printhead is driver circuitry that connects with the imaging electronics, is disposed on the substrate on both sides of the arrangement of printing elements, and drives individual ones of the printing elements in accordance with commands from the imaging electronics to emit light for imprinting points of the latent image on the image receiving surface.

The printhead includes, furthermore, an optical element of elongated shape for focussing light of the printing elements to form the row of the latent image. The focussing is accomplished concurrently for individual ones of the printing elements located in each of the first and the second arrays of the printing elements. In a preferred embodiment of the invention, each of the first and the second arrays comprises a single row of the printing elements.

In the driver circuitry of the printhead, a first portion of the driver circuitry comprises an arrangement of plural rows of printing-element drivers and plural rows of wire-bonding pads. The plural rows of printing-element drivers are interconnected to respective ones of the printing elements of the first array of printing elements via respective pads of the plural rows of wire-bonding pads, wherein the arrangement of plural rows of printing-element drivers and plural rows of wire-bonding pads reduces a spacing of the printing elements for improved resolution of the latent image.

In accordance with various embodiments of the invention, the pitch of the printing elements in the first array of printing elements may be equal to the pitch of the printing elements in the second array of printing elements, and the imaging electronics may activate the printing elements of the first and the second arrays in checkerboard fashion, or in random fashion. The checkerboard or random modes of operation serve to break up any unwanted pattern in the latent and printable images resulting from a defective print element and, thereby, counteract an observer's perception of a streak or line imperfection in the image. Alternatively, the imaging electronics may activate the printing elements of the first and the second arrays in a mode of reduced intensity of light emitted from the printing elements while directing the printing elements of the second array to print the same data as is printed by the printing elements of the first array to compensate for the reduced intensity of the emitted light, thereby to extend the lifetime of the printing elements. In addition, the imaging electronics may activate the printing elements of the first array while reserving activation of the printing elements of the second array for a backup mode of operation in the event of a failure of operation of a printing element of the first array.

In yet another embodiment of the invention, the pitch of the printing elements in the first array of printing elements is greater than the pitch of the printing elements in the second array of printing elements, and the imaging electronics activates the printing elements of the first array or the printing elements of the second array to produce, respectively, a first latent image or a second latent image on said photoreceptor, wherein a resolution of the first latent image is higher than a resolution of the second latent image. In this way, the resolution of the latent image may be adjusted to match the resolution of the imaging data provided by the imaging electronics so as to avoid unnecessary usage of the printing elements in situations of low resolution data, thereby to extend the lifetimes of the printing elements.

Typically, each of the printing elements comprises a light-emitting diode (LED), such as GaAsP or AlGaAs, which, in combination with an epoxy or ceramic or electrically insulated substrate, provides for improved temperature stability. Printing by the print engine may be done in black and white, or in color. In the practice of the invention, it is understood that the term "light" such as that radiated by the LED is not limited to radiation in the visible spectrum, but includes light of longer wavelength, such as infrared, and light of shorter wavelength, such as ultraviolet, in the event that the photochemistry of the photoreceptor is operative in the infrared or ultraviolet portions of the electromagnetic spectrum.

BRIEF DESCRIPTION OF THE DRAWING

The aforementioned aspects and other features of the invention are explained in the following description, taken in connection with the accompanying drawing figures wherein.

Identically labeled elements appearing in different ones of the figures refer to the same element but may not be referenced in the description for all figures.

DETAILED DESCRIPTION OF THE INVENTION

Figure 1:
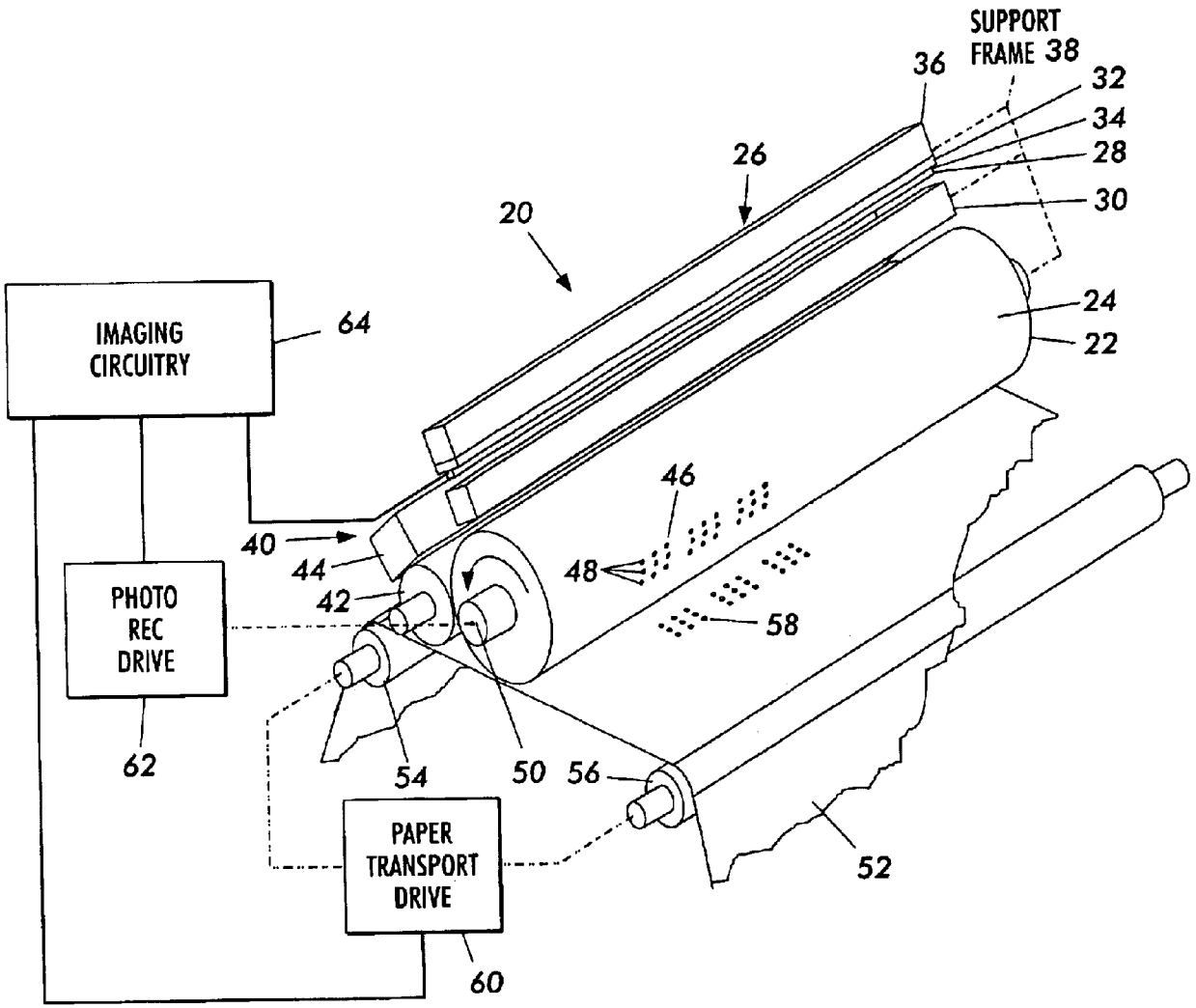
FIG. 1 shows a simplified diagrammatic view of a xerographic printing engine incorporating features of the invention.

With reference to FIG. 1, a xerographic printing engine 20 comprises a photoreceptor 22 in the form of the cylindrical drum with an outer image receiving surface 24 of photosensitive material, and a printhead 26. The printhead 26 has an elongated shape, in the form of a bar, and includes printing elements in the form of sources of light. In a preferred embodiment of the invention, the sources of light are provided by an assembly 28 of LEDs which radiates light through an optical focusing element in the form of an elongated group of fibers of a lens 30 to produce a latent image on the receiving surface 24. The LED assembly 28 is mounted on a substrate 32 which also carries LED driver circuitry 34, wherein heat produced by the driver circuitry 34 and the LED assembly 28 is dissipated by a heat sink 36 disposed on a backside of the substrate 32 opposite the LED assembly 28. Also included in the printhead 26 is a frame 38 which holds the lens 30 adjacent to, but with a small spacing from, the LED assembly 28, and supports the printhead 26 relative to the photoreceptor 22 to maintain a desired spacing between the lens 30 and the image receiving surface 24. Also included within the engine 20 is an image developer 40 comprising a developer roll 42 and a toner dispenser 44 wherein, upon rotation of the photoreceptor 22, the developer roll 42 rotates to transfer particles of the toner from the dispenser 44 to the image receiving surface 24. Electrostatic charges defining the latent image on the image receiving surface 24 secure the toner particles to the image receiving surface 24, thereby to convert the latent image to a printable image.

By way of example, a latent image 46 is shown on the image receiving surface 24 as an array of dots 48 produced by activation of various LEDs of the assembly 28 wherein the dots 48 are shown located on lines which are parallel to a rotational axis 50 of the photoreceptor 22. Further lines of dots 48 in the latent image 46 are imprinted by the printhead 26 during further increments of rotation of the photoreceptor 22 about the axis 50. After conversion of the latent image 46 to a printable image by the developer 40, the printable image is transferred to a suitable medium, such as a sheet of paper 52. The paper 52 is carried by paper transport rolls 54 and 56 past a region of contact of the paper 52 with the image receiving surface 24 during rotation of the photoreceptor 22. The resulting output image 58 imprinted on the paper 52 is shown in the figure to have the same form as the latent image 46. A paper transport drive 60 rotates the rolls 54 and 56 to translate the paper 52 (indicated by an arrow) past the photoreceptor 22. The photoreceptor 22 is rotated (indicated by a curved arrow) by a photoreceptor drive 62. Synchronism between operation of the paper transport drive 60 and the photoreceptor drive 62 is maintained electrically by connection of these drives to imaging circuitry 64. The imaging circuitry 64, in addition to providing the synchronization, also stores data of an image to be printed by the engine 20, and transmits command signals to the LED driver circuitry 34 for activation of the LEDs of the LED assembly 28 to produce the latent image.

Figure 2:
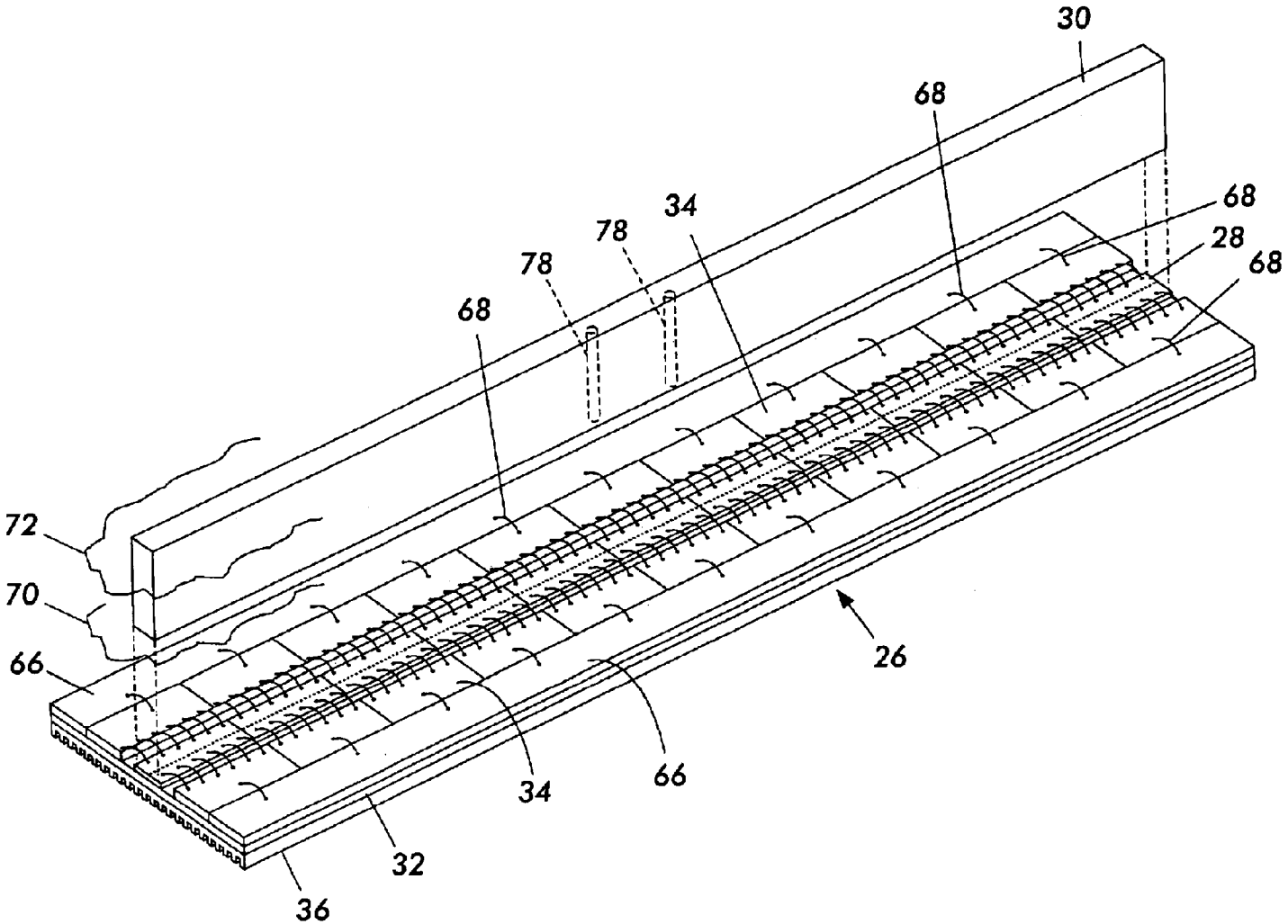
FIG. 2 shows a stylized view of a printhead of the engine of FIG. 1, the printhead incorporating features of the invention, the view being partially exploded by displacement of an optical focussing element to show light-emitting printing elements.

FIG. 2 also shows the foregoing components of the printhead 26, namely, the LED assembly 28, the lens 30, the substrate 32, the LED driver circuitry 34 and the heat sink 36. The driver circuitry 34 is located on both sides of the LED assembly 28 to facilitate connection of electric leads between the driver circuitry 34 and the numerous LEDs of the assembly 28. Also shown are signal buses 66 located on both sides of the LED assembly 28 and supported by the substrate 32 for carrying signals from the imaging circuitry 64 (FIG. 1) to drivers of the driver circuitry 34 disposed on both sides of the LED assembly 28. Electric leads 68, in the form of small wires, are shown connecting between the buses 66 and the driver circuitry 34 as well as between the driver circuitry 34 and the LED assembly 28. An object plane 70 of the lens 30 is indicated in front of the surface of the lens 30 which faces the LED assembly 28. Due to the exploded view of FIG. 2, the object plane 70 appears at a considerable distance from the LED assembly 28, however, the true position of the lens 30 is much closer to the LED assembly 28 than that shown in FIG. 2 so that the object plane 70 is at the emitting surface of the LED assembly 28. An image plane 72 is similarly formed in front of the opposite surface of the lens 30 and, upon emplacement of the printhead 26 in its position relative to the photoreceptor 22 as shown in FIG. 1, lies at the image receiving surface 24.

Figure 3:
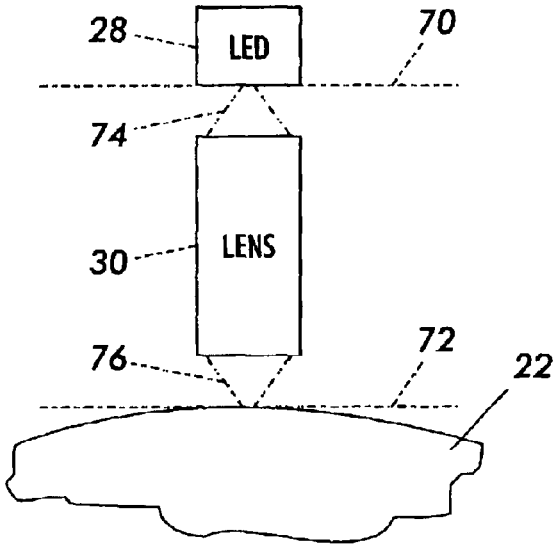
FIG. 3 shows diagrammatically focal plane of the optical element of FIG. 2.

The foregoing relationship of the object plane 70 and the image plane 72 relative to the lens 30 is indicated diagrammatically also in FIG. 3, wherein the object plane 70 is located at the LED assembly 28 and the image plane 72 is located at the surface of the photoreceptor 22. Also indicated in FIG. 3 is an input cone 74 of light propagating from the LED assembly 28 to the lens 30 wherein the width of the cone 74 at the object plane 68 is wide enough to encompass two rows of LEDs as will be described further with reference to FIG. 5. A corresponding output cone 76 of light propagates from the lens 30 to the photoreceptor 22, enabling the light of two rows of the LEDs to the imaged upon the photoreceptor 22.

Figure 4:
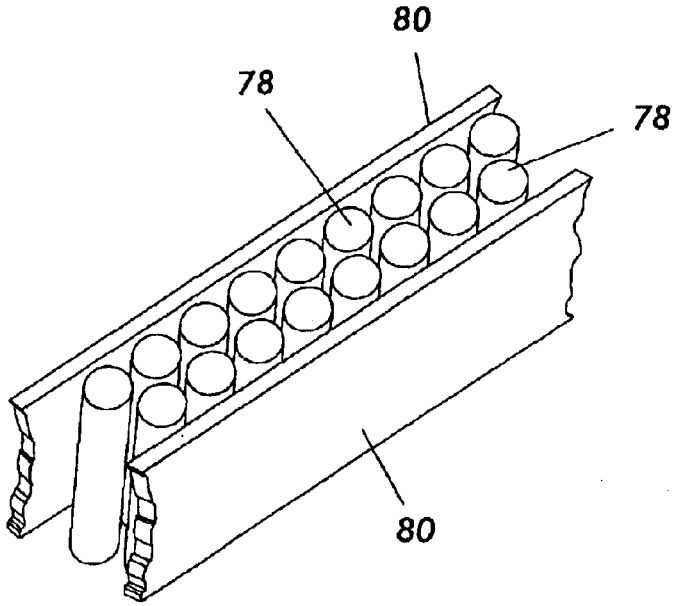
FIG. 4 is a stylized fragmentary view of the optical element of FIG. 2.

The lens 30, in the preferred embodiment of the invention, is constructed in a well-known form available commercially under the name of a SELFOC gradient index lens, as shown in the fragmentary view of FIG. 4, wherein one or more optical fibers 78, constructed as gradient index fibers, are held between two opposed sidewalls 80. The fibers 78 extend in the direction of light propagation between the object plane 70 and the image plane 72 of FIG. 3, and are indicated also in phantom view in FIG. 2.

Figure 5:
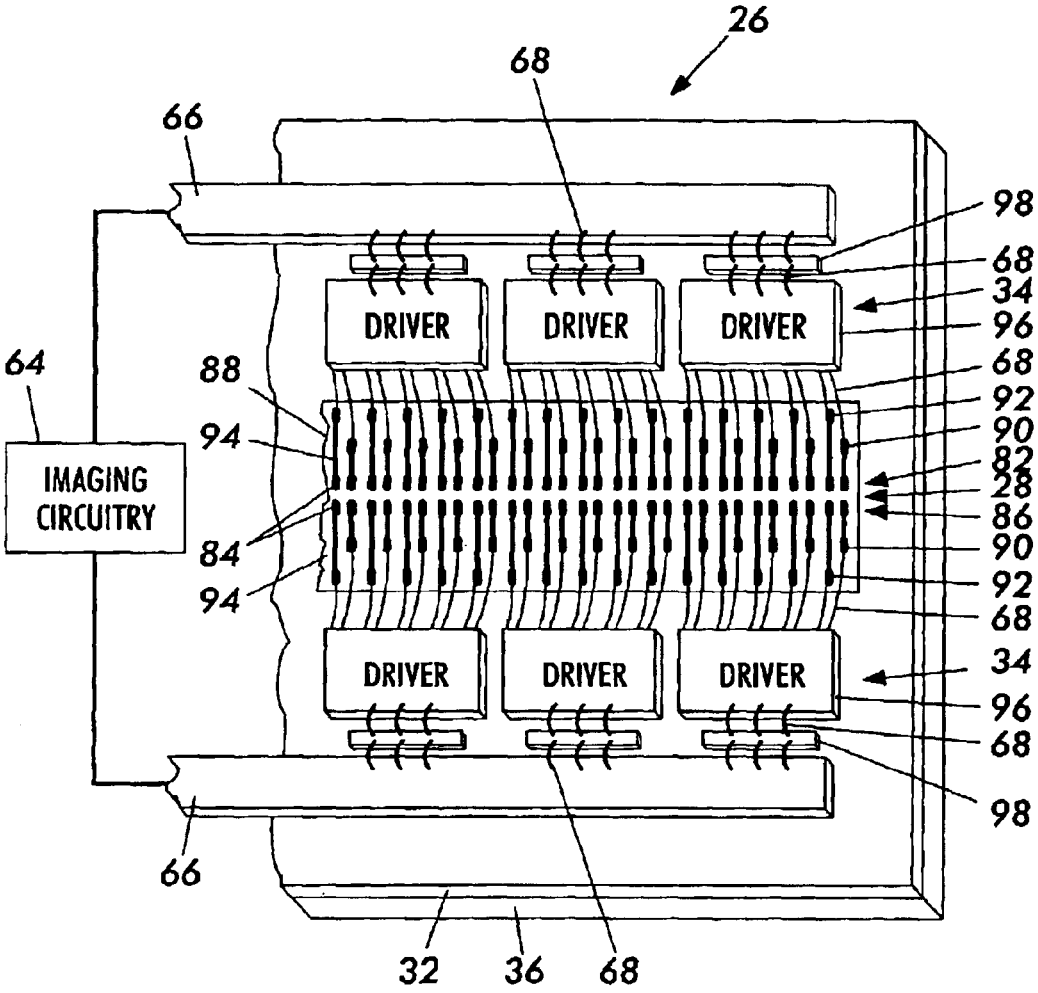
FIG. 5 is a stylized fragmentary view of LEDs and their driver circuitry for the printhead of FIG. 1, and wherein a first array and a second array of the LEDs are disposed on a single die.

In FIG. 5, the fragmentary view of the printhead 26 shows the substrate 32 with the heat sink 36 on a backside thereof, and the LED assembly 28 connected by the leads 68 to the driver circuitry 34 which, in turn, are connected by still further leads 68 to the signal buses 66 for receipt of signals from the imaging circuitry 64. The LED assembly 28 comprises a first (or primary) array 82 of LEDs 84 arranged in a single line or row extending parallel to the buses 66. Each LED in a line of the LEDs 84 prints a corresponding pixel of the image being printed. The LED assembly 28 further comprises a second (or secondary) array 86 of LEDs 84 arranged in a single line or row extending parallel to the buses 66. In this embodiment of the invention, the LEDs 84 of both the first array 82 and the second array 86 are constructed on a single die 88. Also included on the die 88 are pads 90 and 92 to facilitate securing of the leads 68 whereby, for each LED 84, the corresponding lead 68 makes electrical connection with a pad 90 or 92 which, in turn, connects by a conductor 94 to the LED 84. Each of the pads 90, 92 is a bonding pad for wire bonding of the wires of the leads 68. In a preferred embodiment of the invention, the LEDs 84 comprise GaAsP or AlGaAs, and the substrate 32 comprises epoxy or ceramic or an electrically insulated metallic layer for temperature stabilization from heat generated in the LEDs 84 and in the driver circuitry 34.

In accordance with a feature of the invention, a closer spacing of the LEDs 84 in each of the respective array 82 and 86 is attained by staggering the positions of the pads 90 and 92 such that the pads 90 are arranged along an inner row of the pads closer to the LEDs 84 than the pads 92 which are arranged along an outer row of the pads further from the LEDs 84. By virtue of the reduced spacing among the LEDs 84, the printhead 26 is able to provide a higher resolution image. The LED driver circuitry 34, on each side of the LED assembly 28, is composed of a set of driver chips 96 arranged side-by-side in a row parallel to the buses 66. Connection of the driver chips 96 to respective ones of the buses 66 is facilitated by use of relay pads 98 whereby a lead 68 connects between a driver chip 96 and a relay pad 98 and wherein a further lead 68 makes connection from the relay pad 98 to the corresponding bus 66. As is apparent from FIG. 5, the arrangement of the connection of a bus 66 and its associated driver chips 96 for the first array 82 is symmetric to the arrangement of the connection of the other bus 66 and its associated driver chips 96 for the second array 86. Thereby, the imaging circuitry 64 is able to provide independent control for the LEDs 84 of the first array 82 and the LEDs 84 of the second array 86.

In accordance with a further feature of the invention, the row of LEDs 84 in the first array 82, while being spaced apart from the row of the LEDs 84 of the second array 86, have a sufficiently small spacing to enable both rows of the LEDs of the assembly 28 to fall within the acceptance angle of the lens 30 (represented by the input cone 74 of FIG. 3) for directing their light upon the photoreceptor 22. This permits the imaging circuitry 64 to operate the printhead 26 in conjunction with the photoreceptor drive 62 (FIG. 1) to print two rows of dots 48 for one position of the photoreceptor 22 prior to advancing the photoreceptor 22 for a subsequent imprinting of two rows of dots 48. Alternatively, if overprinting is desired, or if only one of the arrays 82 and 86 is to be employed, the imaging circuitry 64 directs rotation of the photoreceptor 22 to advance at only one row of dots 48 at a time. By way of example in a use of the printing engine 20, it may be desirable to employ the first array 82 alone for a printing process, and to rely on the second array 86 as a backup array in the event of a detection of failure in one of more of the LEDs 84 of the first array 82. Alternatively, by way of further example, it may be desired to use some of the LEDs 84 of the first array 82 and some of the LEDs 84 of the second array 86 in a printing process so as to increase the lifetime of the LEDs 84. These optional modes in the utilization of the printing engine 20, as well as other optional modes, will be described in further detail below.

Figure 6:
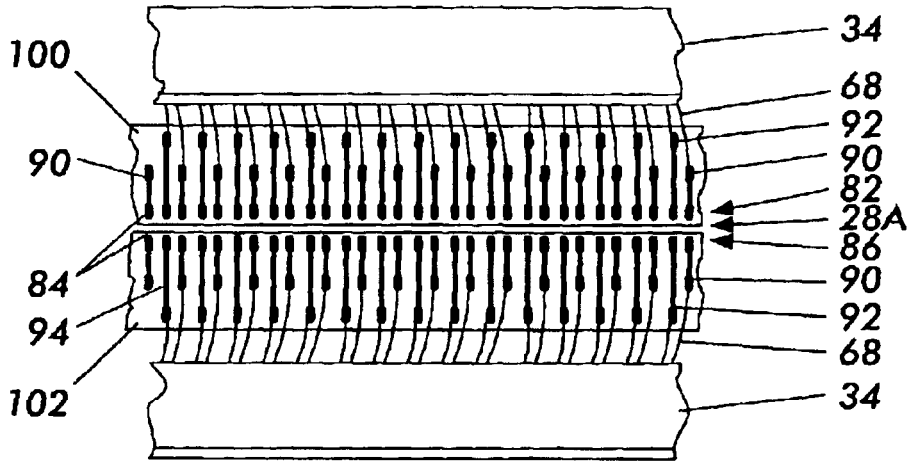
FIG. 6 shows a portion of the first and the second arrays of the LEDs of FIG. 5 in accordance with a further embodiment of the invention wherein the first and the second arrays are disposed on separate dies.

FIG. 6 shows an LED assembly 28A having the same geometric arrangement of LEDs 84 and the pads 90, 92 with the respective leads 68 and conductors 94 in the assembly 28 as has been disclosed in FIG. 5. However, in accordance with an alternative embodiment of the invention of FIG. 6, the LEDs 84 of the first array 82 are disposed on a first die 100 and the LEDs 84 of the second array 86 are disposed on a second die 102 separate from the first die 100. The two assemblies 28 and 28A are functionally equivalent in the operation of the engine 20, however, one or the other on the assemblies 28 and 28A may present a convenience in manufacture of the printhead 26.

Figure 7:
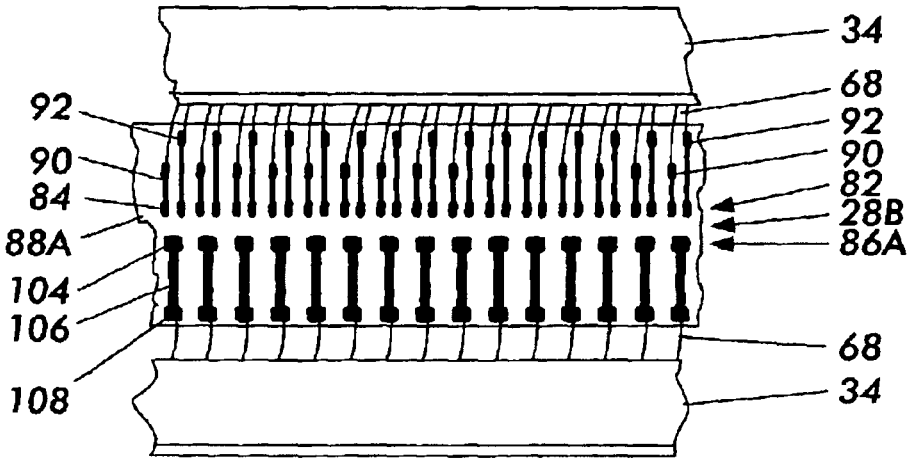
FIG. 7 shows a portion of the first and the second arrays of the LEDs of FIG. 5 in accordance with a further embodiment of the invention wherein the LEDs of each of the first and the second arrays are provided in line arrays of differing pitch to provide for a printing of images with different values of resolution, the two arrays being disposed on a single die.

FIG. 7 shows and LED assembly 28B of an alternative embodiment of the invention which differs from the LED assembly 28 of FIG. 5 in that different arrangements of LEDs are employed in the first array 82 and in a second array 86A of the assembly 28B of FIG. 7. The first array 82 comprises a line array of LEDs 84, as was disclosed for the first array 82 of FIG. 5. However, in FIG. 7, the second array 86A comprises a line array of LEDs 104 having a lower pitch than the pitch of the LEDs 84 of the first array 82. As can be seen in FIG. 7, the spacing, on centers, of the LEDs 104 is greater than the spacing, on centers, of the LEDs 84. The LEDs 84 and 104 are shown disposed on a single die 88A, however, if desired, the LEDs 84 and 104 can be provided on two separate dies analogous to the construction disclosed in FIG. 6. In FIG. 7, the LEDs 104 are connected by conductors 106 to pads 108, and via the leads 68 from the pads 108 to the LED driver circuitry 34. Connection of the LEDs 84 via the pads 90 and 92 to the driver circuitry 34 is the same as has been disclosed above reference to FIGS. 5 and 6. The embodiment of FIG. 7 is convenient for implementing an option in the operation of the engine 20 wherein the first array of LEDs can be employed for printing an image at a higher value of resolution and the second array of the LEDs can be employed for printing an image at a lower value of resolution. The applying of drive signals to the LEDs of the requisite one of the two arrays is accomplished by the imaging circuitry 64 (shown in FIG. 5).

Figure 8:
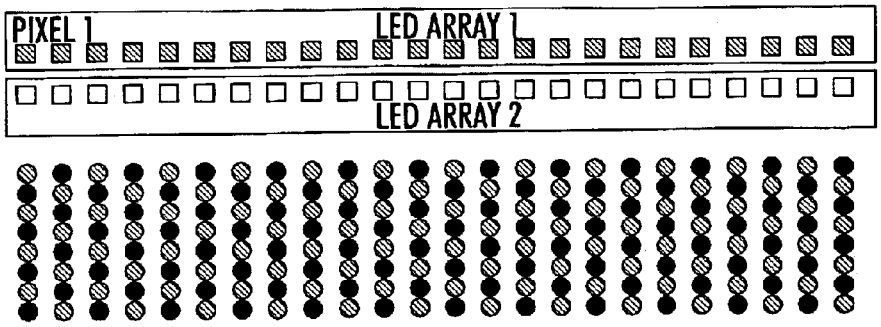
FIGS. 8, 9 and 10 are diagrammatic representations showing the energization of LEDs of the first and the second arrays of the printhead of FIG. 1 during a succession of print lines for the cases, respectively, of checkerboard printing, double (over) printing, and random printing.
Figure 9:
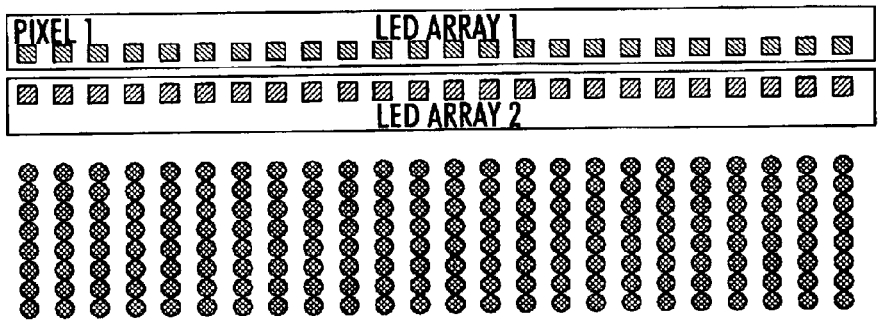
Figure 10:
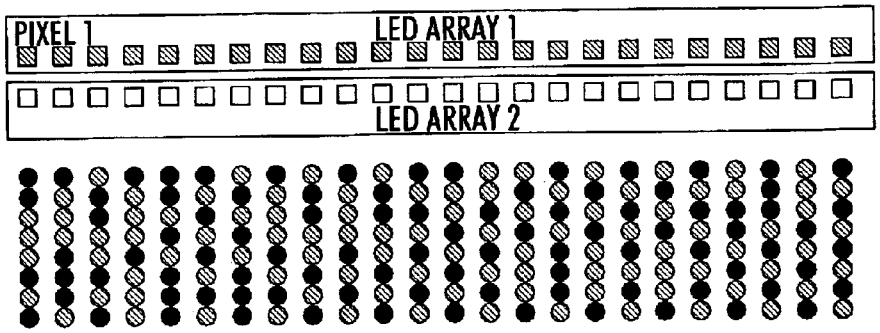

In each of FIGS. 8, 9 and 10, there is a diagrammatic showing of the LEDs of the first array and of the second array wherein the LEDs of the first array and the LEDs of the second array are represented by different forms of hatching. Beneath the arrays of the LEDs, there are shown eight rows of markings imprinted on the photoreceptor 22 by the printhead 26 (FIG. 1). The arrangement of the markings is in rows and columns, the columns being numbered consecutively at the bottom of the figure, with 24 columns being shown by way of example.

For the checkerboard printing of FIG. 8, in any one row of the markings, the first mark is produced by activation of an LED from one of the arrays and the next mark is produced by activation of an LED of the other array. By way of example, with reference to the first row (shown at the bottom of FIG. 8) the first mark is from an LED of the second array, the second mark is from an LED of the first array, with the sequence of markings continuing in alternating fashion. In the second row, the first mark is from an LED of the first array and the second mark is from an LED of the second array. The checkerboard printing mode reduces the utilization of the LEDs so as to extend their lifetimes, and also inhibits generation of a noticeable line or streak in an output image of the engine 20 due to a defective LED or its drive circuit.

For the double printing, also referred to as overprinting, of FIG. 9, a line of an image is printed by the LEDs of the first array, and then the photoreceptor 22 (FIG. 1) is rotated by an incremental rotation corresponding to the spacing between lines of the image, whereupon the LEDs of the second array are activated to print markings upon the markings already imprinted at the corresponding locations by the LEDs of the first array. This printing mode has the benefit of hiding an empty space resulting in an image from a failure of an LED of one of the arrays to print.

The random printing of FIG. 10 is an alternative to the checkerboard printing of FIG. 8 wherein, instead of implementing a specific pattern of alterations of excitation of the LEDs of the two arrays, as disclosed in FIG. 8, in FIG. 10, the selection of LEDs for activation in the two arrays is accomplished in random fashion. This printing mode is also useful in inhibiting generation of a noticeable line or streak in an output image of the engine 20 due to a defective LED or its drive circuit. Furthermore, since the LEDs are energized only part of the time, as compared to the full time printing of the double printing mode of FIG. 9, the random mode of FIG. 10 extends the lifetime of the LEDs as compared to the double printing mode of FIG. 9.

Figure 11:
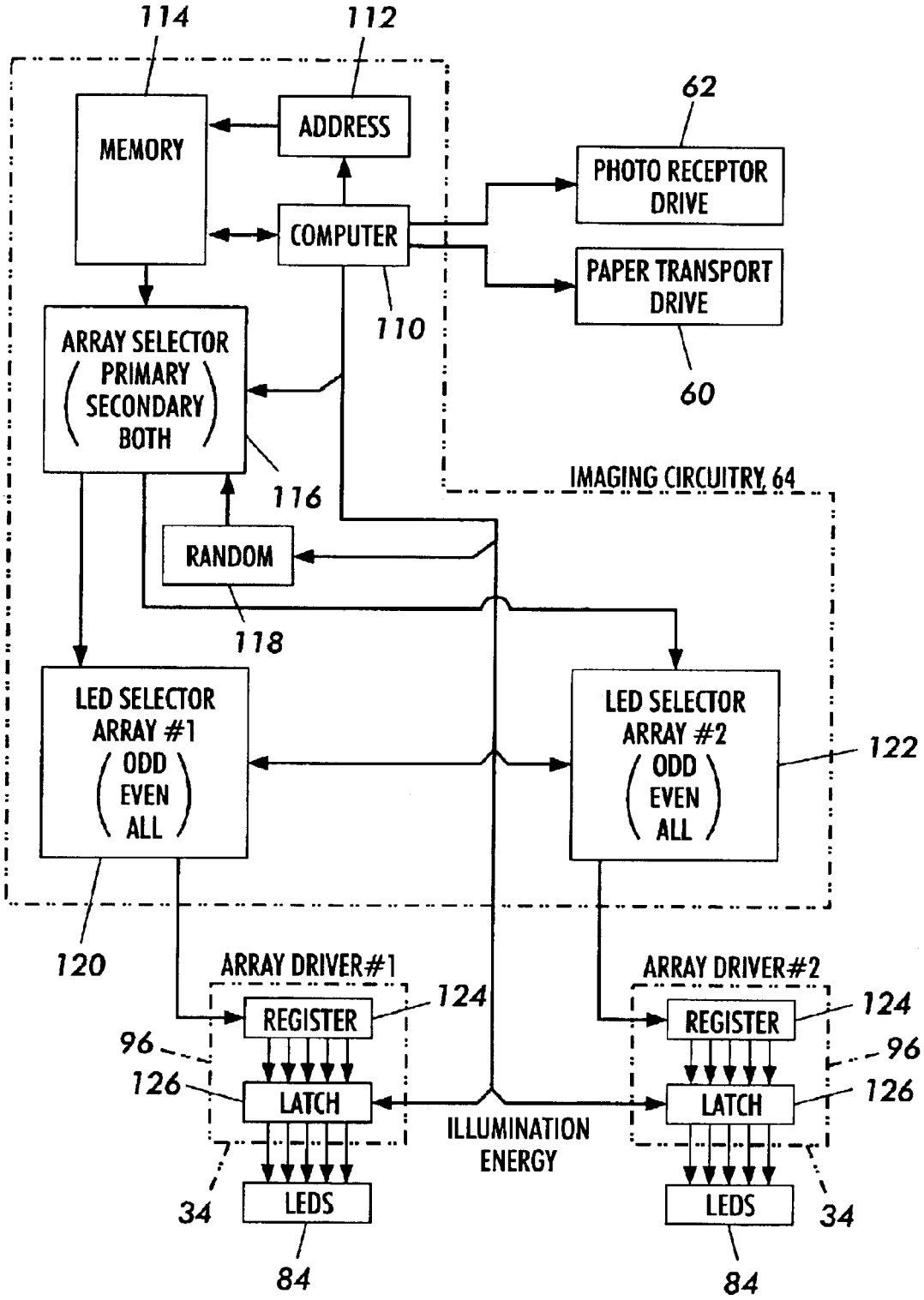
FIG. 11 is a block diagram showing details of the imaging circuitry of FIG. 1.

With reference to FIG. 11, the imaging circuitry 64 comprises a computer 110, an address unit 112, a memory 114, an array selector 116, a random number generator 118, an LED selector 120 for the first array, and an LED selector 122 for the second array. In operation, data of an image to be printed is stored in the memory 114. The data may have been obtained initially by the scanning of an object or by other means. In order to output the data for activation of the LEDs, the computer 110 addresses the memory 114 by use of the address unit 112. In accordance with the addressing, the memory 114 outputs data of the respective pixels of the image to the array selector 116, thereby to command the LEDs corresponding to the addressed pixels to emit light or to remain dark. Concurrently with the addressing of pixels of successive lines of an image stored in the memory 114, the computer 110 outputs command signals to the photoreceptor drive 62 and to the paper transport drive 60 for advancing the photoreceptor 22 and the paper 52 to the requisite positions for printing the lines of the image.

The function of the array selector 116 is to steer the LED excitation signals to either the first array 82 or the second array 86 (FIG. 5) of the LEDs 84. Selection of either the primary array or the secondary array or of both arrays is commanded by the computer 110 based on the chosen mode of printing. In the event that the random mode of printing has been chosen, the signal outputted by the computer 110 is applied to the random number generator 118 for selecting the array wherein an LED is to be activated. By way of example, the random number generator 118 may operate modulo-2 for selecting one or the other of the arrays.

The function of each of the LED selectors 120 and 122 is to implement checkerboard printing. Each of the selectors 120 and 122 is able to select, within its array of LEDs, activation of only the odd numbered LEDs, or activation of only the even numbered LEDs, or activation of all of the LEDs. If the checkerboard printing mode is not desired, then the computer 110 commands the selectors 120 and 122 to pass the LED activation signals to all of the LEDs. If the checkerboard printing mode is desired, then the computer 110 commands one of the selectors 120, 122 to activate the odd numbered LEDs and the other of the selectors 120, 122 to activate the even numbered LEDs.

Each of the driver chips 96 in the LED driver circuitry 34 for the first array and for the second array includes a register 124 which receives the LED command signals from the memory 114 and a latch 126 which holds the command signals during operation of the LEDs 84. As a further option in the operation of the printing engine 20, in order to lengthen the lifetime of the LEDs 84, both of the arrays 82 and 86 (FIG. 5) can be operated concurrently but with the LEDs being operated at a lower level of energy output. The reduced energy output can be accomplished by reducing the interval of time during which an LED is radiating light. This is accomplished by the computer 110 by application of a strobe signal to the latch 126 in the LED driver circuitry 34 for each of the arrays, wherein the duration of the strobe signal controls the duration of the light pulse emitted by the LEDs. In the energy-saving mode, the duration of the strobe signal applied to the latch 126 is reduced from the normal duration of the strobe signal. This mode may be combined with the double printing mode of FIG. 9 so that the photoreceptor 22 receives sufficient light energy for each of the markings of an individual print line. The total number of lines per page may be maintained the same as for printing by only the first array 82.

It is to be understood that the above-described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A printhead for genration of a set of points of an image from plural arrays of printing elements, the image being composed of rows of said image points, comprising:

a substrate extending in a direction parallel to a row of an image to be imprinted by the printhead on an image receiving surface, plural arrays of light-emiting printing elements disposed on said substrate wherein said plural arrays extend in said direction, and driver circuitry disposed on said substrate for activating individual ones of said printing elements to emit light for imprinting points of said image on said image receiving surface;

an optical element for focussing light of said printing elements onto said row of said image, said focussing being accomplished for individual ones of said printing elements located in a first of said arrays and in a second of said arrays arranged alongside said first array; and wherein a pitch of the printing elements in said first array of printing elements is greater than the pitch of the printing elements in said second array of printing elements to permit formation of latent images by individual ones of said arrays of which a resolution of a first latent image is higher than a resolution of a second latent image.

2. A printhead according to claim 1 wherein each of said first array and said second array comprises a single row of said printing elements.

3. A printhead according to claim 2 wherein said optical element is elongated in said direction for producing an image plane and an object plane locate on opposite sides of the optical element, said object plane extending on said printing elements located in said first array and in said second array, said image plane being located on said image receiving surface, and wherein individual ones of said printing elements in said first array are spaced apart from individual ones of said printing elements in said second array.

4. A printhead according to claim 3 wherein said optical element comprises plural rows of gradient index fibers producing said image plane and said object plane.

5. A printhead according to claim 3 wherein a first portion of said driver circuitry and a second portion of said driver circuitry are located on opposite sides of said plural arrays of printing elements, said first portion of the driver circuitry being located adjacent said first array of printing elements and said second portion of said driver circuitry being located adjacent said second array of printing elements.

6. A printhead according to claim 5 wherein each of said printing elements comprises a light-emitting diode (LED).

7. A printhead according to claim 6 wherein said light-emitting diode comprises GaAsP or AlGaAs.

8. A printhead according to claim 5 wherein:

said first portion of driver circuitry comprises an arrangement of a row of printing-element drivers and plural rows of wire-bonding pads by which said printing-element drivers are interconnected to respective ones of the printing elements of said first array of printing elements;

said second portion of driver circuitry comprises an arrangement of a row of printing-element driver and plural rows of wire-bonding pads by which said printing-element drivers are interconnected to respective ones of the printing elements of said second array of printing elements; and wherein, for each of said first and said second portions of the driver circuitry, said arrangement of the row of printing-element drivers and plural rows of wire-bonding pads enables a close spacing of the printing elements for improved resolution of said image.

9. A xerographic print engine comprising a photoreceptor with an image receiving surface, a developer for converting a latent image produced on said receiving surface to a printable image to be transferred from said photoreceptor to a print medium, a printhead for directing light to said photoreceptor to produce said latent image, and a printing controller for imparting relative motion between said photoreceptor and said print medium to print said printable image on said medium, said print controller including imaging electronics for applying imaging data to said printhead for generation of said latent image; and wherein said printhead generates a set of points of the latent image, the latent image being composed of rows of said image points, the printhead comprising:

a substrate extending in a direction parallel to a row of the latent image, plural arrays of light-emitting printing elements disposed on said substrate wherein said plural arrays extend in said direction, and driver circuitry connected to said imaging electronics and being disposed on said substrate for activating individual ones of said printing elements to emit light for imprinting points of said latent image on said image receiving surface;

an optical element for focussing light of said printing elements onto said row of said latent image, said focussing being accomplished concurrently for individual ones of said printing elements located in a first of said arrays and in a second of said arrays arranged alongside said first array; and wherein, in said printhead, a pitch of the printing elements in said first array of printing elements is greater than the pitch of printing elements in said second array of printing elements to permit formation of latent images by individual ones of said arrays of which a resolution of a first latent image is higher than a resolution of a second latent image.

10. A print engine according to claim 9 wherein each of said first array and said second array comprises a single row of said printing elements.

11. A print engine according to claim 10 wherein, in said printhead, said optical element is elongated in said direction for producing an image plane and an object plane located on opposite sides of the optical element, said object plane extending on said printing elements located in said first array and in said second array, said image plane being located on said image receiving surface, and wherein individual ones of said printing elements in said first array are spaced apart from individual ones of said printing elements is said second array.

12. A print engine according to claim 11 wherein, in said printhead, a first portion of said driver circuitry and a second portion of said driver circuitry are located on opposite sides of said plural arrays of printing elements, said first portion of the driver circuitry being located adjacent said first array of printing elements and said second portion of said driver circuitry being located adjacent said second array of printing elements.

13. A print engine according to claim 12 wherein, in said printhead, said printing elements comprise light-emitting diodes of GaAsP or AlGaAs, and said substrate comprises epoxy or ceramic or an electrically insulated metallic layer for temperature stabilization from heat generated in said printing elements and in said driver circuitry.

14. A print engine according to claim 12 wherein, in said printhead, said first portion of driver circuitry comprises an arrangement of a row of printing-element drivers and plural rows of wire-bonding pads by which said printing-element drivers are interconnected to respective ones of the printing elements of said first array of printing elements;

said second portion of driver circuitry comprises an arrangement of a row of printing-element drivers and plural rows of wire-bonding pads by which said printing-element drivers are interconnected to respective ones of the printing elements of said second array of printing elements; and wherein, for each of said first and said second portions of the driver circuitry, said arrangement of the row of printing-element drivers and plural rows of wire-bonding pads reduces a spacing of the printing elements for improved resolution of said latent image.

15. A print engine according to claim 9 wherein said printable image is produced in color.

16. A print engine according to claim 9 wherein said printable image is produced in black and white.

17. A xerographic print engine comprising a photoreceptor with an image receiving surface, a developer for converting a latent image produced on said receiving surface to a printable image to be transferred from said photoreceptor to a print medium, a printhead for directing light to said photoreceptor to produce said latent image, and a printing controller for imparting relative motion between said photoreceptor and said print medium to print said printable image on said medium, said print controller including imaging electronics for applying imaging data to said printhead for generation of said latent image; and wherein said printhead generates a set of points of the latent image, the latent image being composed of rows of said image points, the printhead comprising:

a substrate extending in a direction parallel to row of the latent image, plural arrays of light-emitting printing elements disposed on said substrate wherein said plural arrays extend in said direction, and driver circuitry connected to said imaging electronics and being disposed on said substrate for activating individual ones of said printing elements to emit light for imprinting points of said latent image on said image receiving surface; and an optical element for focussing light of said printing elements onto said row of said latent image, said focussing being accomplished concurrently for individual ones of said printing elements located in a first of said arrays and in a second of said arrays arranged alongside said first array;

wherein each of said first array and said second array comprises a single row of said printing element;

in said printhead, said optical element is elongated in said direction for producing an image plane and an object plane located on opposite sides of the optical element, said object plane extending on said printing elements located in said first array and in said second array, said image plane being located on said image receiving surface, and wherein individual ones of said printing elements in said first array are spaced apart from individual ones of said printing elements is said second array; and in said printhead, the pitch of the printing elements in said first array of printing elements is equal to the pitch of the printing elements in said second array of printing elements, and said imaging electronics activates said printing elements of said first array and said second array in each of two modes, of which a first of the modes is a checkerboard fashion and a second of the modes is a mode of reduced intensity of light emitted from the printing elements; wherein, in said second mode, the imaging electronics directs the printing elements of said second array to print the same data as is printed by the printing elements of said first array to compensate for the reduced intensity of the emitted light, thereby to extend the lifetime of the printing elements.

18. A xerographic print engine comprising a photoreceptor with an image receiving surface, a developer for converting a latent image produced on said receiving surface to a printable image to be transferred from said photoreceptor to a print medium, a printhead for directing light to said photoreceptor to produce said latent image, and a printing controller for imparting relative motion between said photoreceptor and said print medium to print said printable image on said medium, said print controller including imaging electronics for applying imaging data to said printhead for generation of said latent image; and wherein said printhead generates a set of points of the latent image, the latent image being composed of rows of said image points, the printhead comprising:

a substrate extending in a direction parallel to a row of the latent image, plural arrays of light-emitting printing elements disposed on said substrate wherein said plural arrays extend in said direction, and drive circuitry connected to said imaging electronics and being disposed on said substrate for activating individual ones of said printing elements to emit light for imprinting points of said latent image on said image receiving surface; and an optical element for focussing light of said printing elements onto said row of said latent image, said focussing being accomplished concurrently for individual ones of said printing elements located in a first of said arrays and in a second of said arrays arranged alongside said first array;

wherein each of said first array and said second array comprises a single row of said printing elements;

in said printhead, said optical element is elongated in said direction for producing an image plane and an object plane located on opposite sides of the optical element, said object plane extending on said printing elements located in said first array and in said second array, said image plane being located on said image receiving surface, and wherein individual ones of said printing elements in said first array are spaced apart from individual ones of said printing elements is said second array; and in said printhead, the pitch of the printing elements in said first array of printing elements is equal to the pitch of the printing elements in said second array of printing elements, and said imaging electronics activates said printing elements of said first array and said second array in each of two modes, of which a first of the modes is a random fashion and a second of the modes is a mode of reduced intensity of light emitted from the printing elements; wherein, in said second mode, the imaging electronics directs the printing elements of said second array to print the same data as is printed by the printing elements of said first array to compensate for the reduced intensity of the emitted light, thereby to extend the lifetime of the printing elements.

19. A xerographic print engine comprising a photoreceptor with an image receiving surface, a developer for converting a latent image produced on said receiving surface to a printable image to be transferred from said photoreceptor to a print medium, a printhead for directing light to said photoreceptor to produce said latent image, and a printing controller for imparting relative motion between said photoreceptor and said print medium to print said printable image on said medium, said print controller including imaging electronics for applying imaging data to said printhead for generation of said latent image; and wherein said printhead generates a set of points of the latent image, the latent image being composed of rows of said image points, the printhead comprising:

a substrate extending in a direction parallel to a row of the latent image, plural arrays of light-emitting printing elements disposed on said substrate wherein each of a first and a second of said plural arrays comprise a row of printing elements extending in said direction, and driver circuitry connected to said imaging electronics and being disposed on said substrate for activating individual ones of said printing elements to emit light for imprinting points of said latent image on said image receiving surface;

an optical element for focussing light of said printing elements onto said row of said latent image, said focussing being accomplished concurrently for individual ones of said printing elements located in a first of said arrays and in a second of said arrays arranged alongside said first array; and wherein, in said printhead, the pitch of the printing elements in said first array of printing elements is greater than the pitch of the printing elements in said second array of printing elements, and said imaging electronics activates said printing elements of said first array or the printing elements of said second array to produce, respectively, a first latent image or a second latent image on said photoreceptor, wherein a resolution of said first latent image is higher than a resolution of said second latent image.

20. A xerographic print engine comprising a photoreceptor with an image receiving surface, a developer for converting a latent image produced on said receiving surface to a printable image to be transferred from said photoreceptor to a print medium, a printhead for directing light to said photoreceptor to produce said latent image, and a printing controller for imparting relative motion between said photoreceptor and said print medium to print said printable image on said medium, said print controller including imaging electronics for applying imaging data to said printhead for generation of said latent image; and wherein said printhead generates a set of prints of the latent image, the latent image being composed of rows of said image points, the printhead comprising:

a substrate extending in a direction parallel to a row of the latent image, plural arrays of light-emitting printing elements disposed on said substrate wherein each of a first and a second of said plural arrays comprises a row of printing elements extending in said direction and driver circuitry connected to said imaging electronics and being disposed on said substrate for activating individual ones of said printing elements to emit light for imprinting points of said latent image on said image receiving surface;

an optical element for focussing light of said printing elements onto said row of said latent image, said focussing being accomplished concurrently for individual ones of said printing elements located in a first of said arrays and in a second of said arrays arranged alongside said first array; and wherein, in said printhead, the pitch of the printing elements in said first array of printing elements is equal to the pitch of the printing elements in said second array of printing elements, and said imaging electronics activates said printing elements of said first array and said second array in a mode of reduced intensity of light emitted from the printing elements while directing the printing elements of said second array to print the same data as is printed by the printing elements of said first array to compensate for the reduced intensity of the emitted light, thereby to extend the lifetime of the printing elements.

* * * * *